US008006583B2

(12) United States Patent
Yoda

(10) Patent No.: US 8,006,583 B2
(45) Date of Patent: Aug. 30, 2011

(54) FORCING DEVICE FOR A MOVING LEVER

(75) Inventor: Yuji Yoda, Kai (JP)

(73) Assignee: Mitsui Mining and Smetting Co. (JP)

( * ) Notice: Subject to any disclaimer, the term of this patent is extended or adjusted under 35 U.S.C. 154(b) by 1072 days.

(21) Appl. No.: 11/825,701

(22) Filed: Jul. 9, 2007

(65) Prior Publication Data

US 2008/0121062 A1 May 29, 2008

(30) Foreign Application Priority Data

Jul. 10, 2006 (JP) ..... 2006-188772

(51) Int. Cl.
*G05G 1/00* (2006.01)
*E05C 3/06* (2006.01)
*E05C 3/16* (2006.01)

(52) U.S. Cl. ..... 74/470; 74/469; 292/201; 292/216

(58) Field of Classification Search ..... 74/469, 74/470; 292/201, 216
See application file for complete search history.

(56) References Cited

U.S. PATENT DOCUMENTS 4,639,701 A * 1/1987 Shimp ..... 335/21
5,154,369 A * 10/1992 Smith ..... 242/233
6,343,817 B1 * 2/2002 Watanabe ..... 292/216
6,406,073 B1 * 6/2002 Watanabe ..... 292/216
2009/0160198 A1 * 6/2009 Yoda ..... 292/201

FOREIGN PATENT DOCUMENTS

GB 2395980 * 6/2004
JP 3-151480 * 6/1991 ..... 70/190
JP 7-26529 6/1995
JP 9-25755 * 1/1997

OTHER PUBLICATIONS

Machine translation of JP 7-26529.*

* cited by examiner

*Primary Examiner* — Vinh T. Luong
(74) *Attorney, Agent, or Firm* — Skinner and Associates

(57) ABSTRACT

A fixed support is provided on a base member near a moving lever. A moving support is provided on the moving lever. A coil spring comprises a coil and a pair of arms extending from the coil. The fixed support is wound with the coil. The moving support is held between the two arms of the coil spring and pressed by outward force of the coil spring thereby assuring smooth reverse of a direction of the force.

5 Claims, 4 Drawing Sheets

FORCING DEVICE FOR A MOVING LEVER

BACKGROUND OF THE INVENTION

The present invention relates to a forcing device for a moving lever, comprising the moving lever that reciprocates between two positions, force being applied to the moving lever and being able to reverse at an intermediate position between the two positions.

In a conventional forcing device for a moving lever in JP7-26529Y2, particularly in FIG. 12, a coil spring is disposed between a base member and a moving lever pivotally secured to the base member, and each arm of the coil spring engages in holes of the base member and moving lever thereby enabling a forcing direction to the moving lever to reverse at an intermediate position between a moving range of the moving lever.

However, in the device, each of the arms of the coil spring engages with the base member and moving lever respectively and the coil spring moves while tilting toward an axis of the moving lever when the coil spring reverses at a neutral position of the moving lever. Thus, owing to the tilting of the coil spring, an axially-inclined force acts to the moving lever, so that the moving lever loosens axially thereby making it difficult for the moving lever to act smoothly.

SUMMARY OF THE INVENTION

In view of the disadvantages in the prior art, it is an object of the invention to provide a forcing device for a moving lever in which a direction of a force which acts to the moving lever can be reversed stably.

BRIEF DESCRIPTION OF THE DRAWINGS

The features and advantages of the invention will become more apparent from the following description with respect to an embodiment as shown in accompanying drawings wherein.

DETAILED DESCRIPTION OF REFERRED EMBODIMENT

Figure 1:
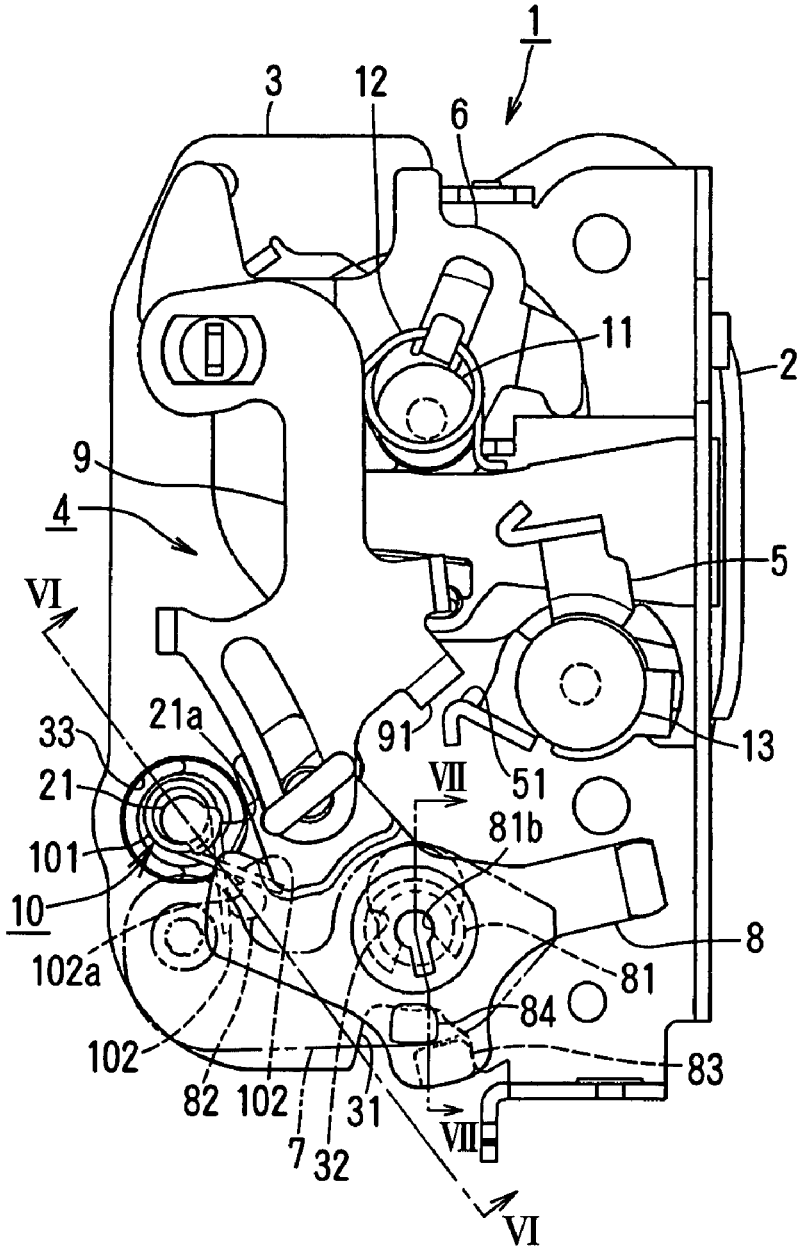
FIG. 1 is a front elevational view of a vehicle door latch device to which the present invention is applied.
Figure 2:
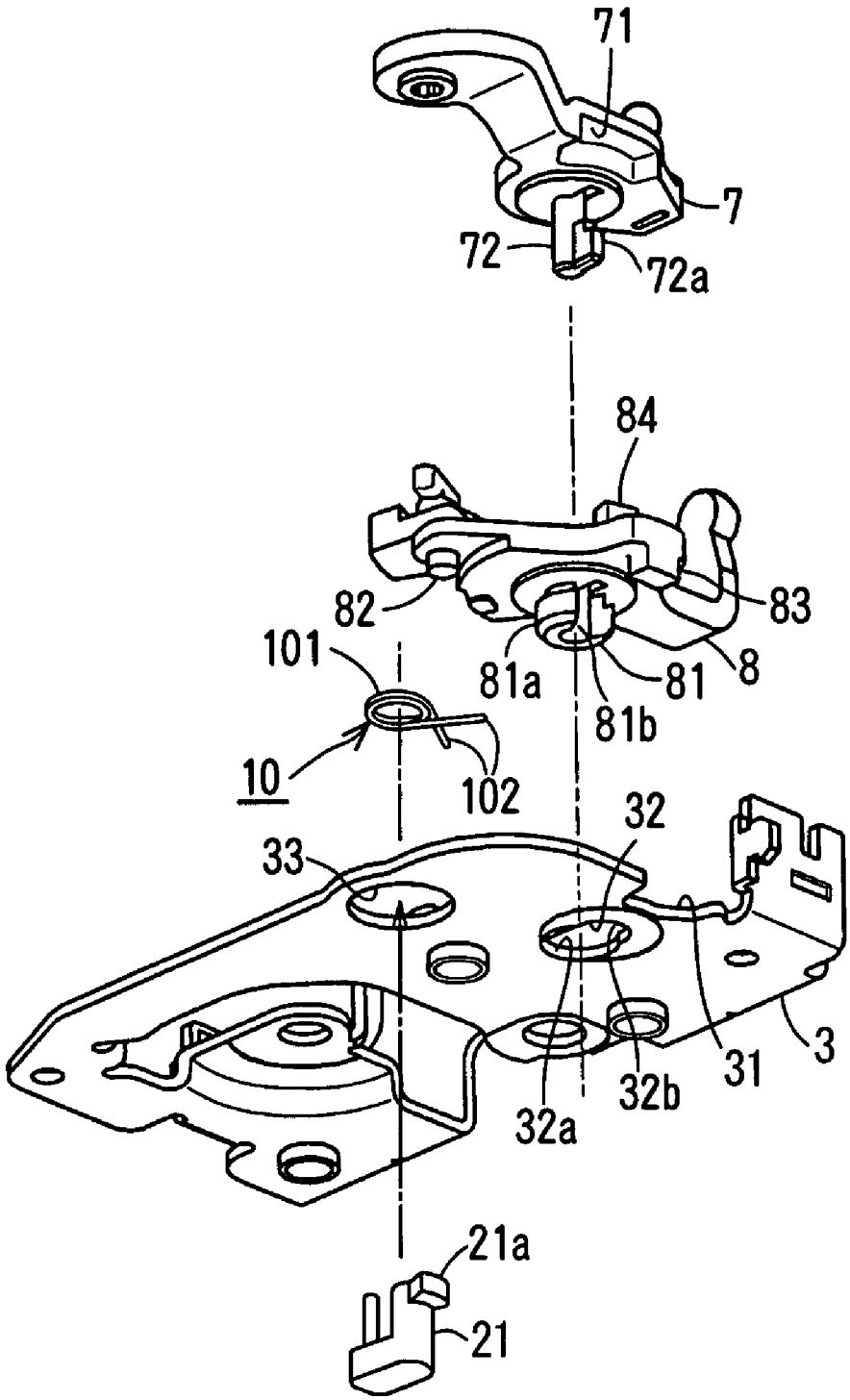
FIG. 2 is an exploded perspective view of the main part thereof.

A vehicle door latch device 1 comprises a synthetic-resin body 2 including an engagement that engages with a striker (not shown) of a vehicle body to enable a door to be held in a closed position; a base member or a metal base plate 3 fixed to the front surface of the body 2; and an operating mechanism 4 comprising a plurality of levers coupled on the front surface of the base plate 3.

The operating mechanism 4 comprises an opening lever 5 coupled to the engagement; an outside lever 6 worked by an outside handle (not shown) on the outer surface of the door; a key lever 7 worked by a locking/unlocking key cylinder (not shown) provided on the outer surface of the door; a moving lever or a locking lever 8 worked by the key lever 7; a subsidiary lever 9 between the outside lever 6 and locking lever 8; and a coil spring 10 for forcing the locking lever 8.

A fixed support 21 of the body 2 is provided at the base plate 3 in the vicinity of the locking lever 8. The fixed support 21 projects from the base plate 3 through an opening 33 by fixing the base plate 3 to the body 2. At the end of the fixed support 21, a projection 21*a* restricts axial motion to prevent a coil 101 from taking off the fixed support 21, when the outer circumferential surface of the fixed support 21 is wound with the coil 101 of the coil spring 10.

The outside lever 6 is pivotally secured on the base plate 3 with a pivot 11 and turned in a releasing direction or counterclockwise in FIG. 1 against the force of the spring 12 according to a door-opening operation of the outside handle.

Figure 3:
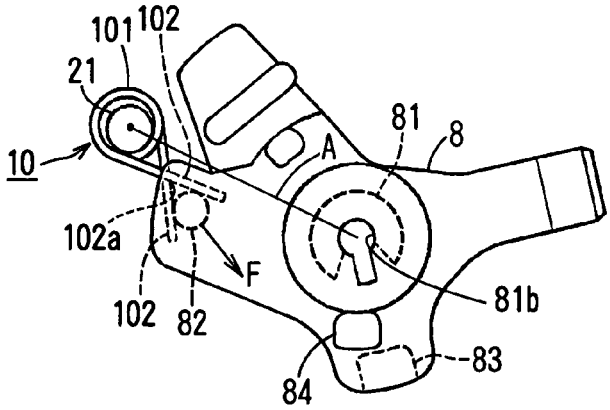
FIG. 3 is a front view of the first position of a locking lever.
Figure 4:
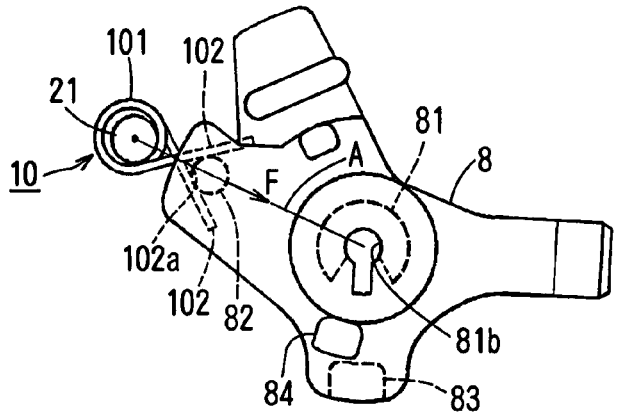
FIG. 4 is a front view of an intermediate position of the locking lever.
Figure 5:
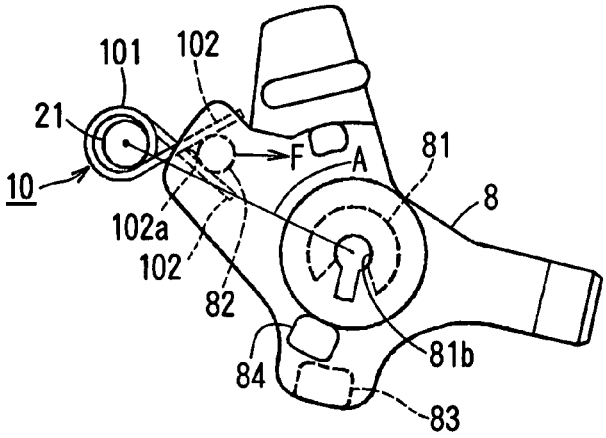
FIG. 5 is a front view of the second position of the locking lever.
Figure 6:
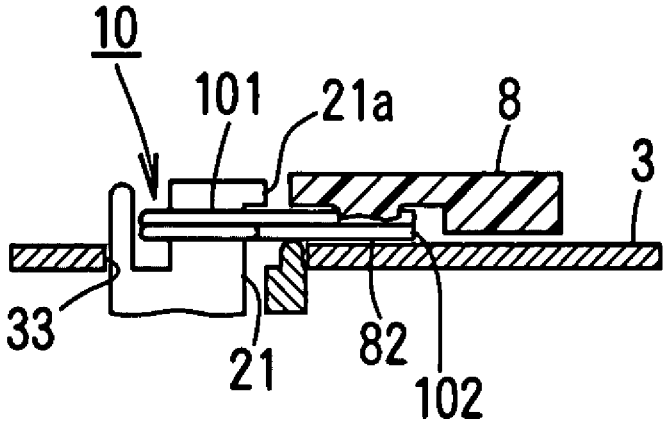
FIG. 6 is a horizontal sectional view taken along the line VI-VI in FIG. 1.
Figure 7:
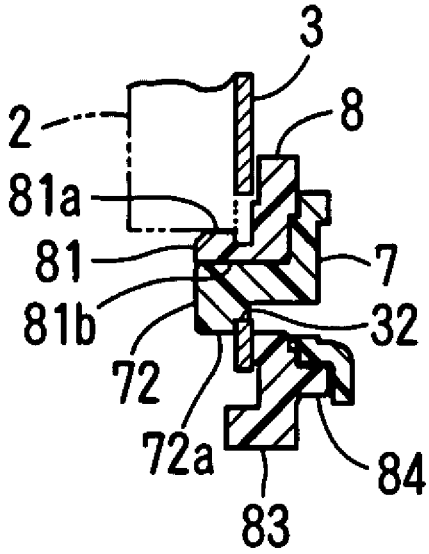
FIG. 7 is a vertical sectional view taken along the line VII-VII in FIG. 1.

The locking lever 8 is pivotally secured on the base plate 3 with a pivot 81 at the center thereof and supported to reciprocate between an unlocking or first position in FIGS. 1 and 3 for validating the door-opening operation of the outside handle and a locked or second position in FIG. 5 for invalidating it. The locking lever 8 is pressed toward an unlocking direction or counterclockwise in FIG. 1 and FIGS. 3-5 and a locking direction or clockwise in FIG. 1 and FIGS. 3-5.

A protrusion 83 on the back of the locking lever 8 contacts the right edge of recess 31 of the base plate 3 when the locking lever 8 is in the unlocking position, and contacts the left edge of the recess 31 when the locking lever 8 is in the locked position. Thus, the locking lever 8 is limited in turning.

The pivot 81 of the locking lever 8 puts in a larger-diameter portion 32*a* of a hole 32 of the base plate 3 and is moved perpendicular of its axis, so that a collar 81*a* of the pivot 81 engages on a smaller-diameter portion 32*b* of the hole 32. After the pivot 81 puts in the hole 32, the body 2 is allowed to contact the outer periphery of the pivot 81 partially to enable the pivot 81 not to move perpendicular to its axis.

A pivot 72 of the key lever 7 is inserted in a key-like aperture 81*b* of the pivot 81 of the locking lever 8 to allow the key lever 7 to be supported coaxially with the locking lever 8.

With the key cylinder, the key lever 7 turns in the locking direction or clockwise or in the unlocking direction or counterclockwise from the neutral position in FIG. 1.

The locking lever 8 is pivotally secured in the hole 32 of the base plate 3 while the pivot 72 of the key lever 7 is placed in the aperture 81*b* of the locking lever 8, so that a radial projection 72*a* of the pivot 72 engages on the smaller-diameter portion 32*b* of the hole 32 to enable the pivot 72 to turn in the aperture 81*b* of the locking lever 8.

The key lever 7 turns from the neutral position in the locking direction to allow a projection 84 of the locking lever 8 to contact the left edge of a groove 71 of the key lever 7. So the locking lever 8 moves from the locked position to the unlocking position.

The subsidiary lever 9 is pivotally secured to the outside lever 6 at the upper end, and connected to the locking lever 8 at the lower end slidably.

When the locking lever 8 is in the unlocking position, the outside lever 6 turns in the releasing direction to allow the subsidiary lever 9 to move downward. Thus, a releasing portion 91 of the subsidiary lever 9 contacts a contact portion 51 of the opening lever 5 to enable the opening lever 5 to turn in the releasing direction around the pivot 13 thereby allowing the engagement to disengage from the striker, so that the door can be opened.

When the locking lever 8 is in the locked position, even if the outside lever 6 turns in the releasing direction to allow the subsidiary lever 9 to go down, the releasing portion 91 does not contact the contact portion 51 of the opening lever 5 to make it impossible for the opening lever 5 to turn in the releasing direction. So the door cannot be opened.

On the back of the locking lever 8, a cylindrical moving support 82 projects toward the base plate 3. With the turning of the locking lever 8, the moving support 82 moves across a border line A between the center of the pivot 81 and the fixed support 21. When the locking lever 8 is in the unlocking position in FIG. 3, the moving support 82 is positioned at one side of the border line A or clockwise. When the locking lever 8 is in the locked position in FIG. 5, the moving support 82 is positioned in the other side of the border line A or counterclockwise. When the locking lever 8 is in the middle of the range between the unlocking position and locked position, the moving support 82 is on the border line A in FIG. 4.

The coil spring 10 comprises a pair of arms 102, 102 which extends tangentially from the coil 101 and crosses each other. The coil 101 rotatably surrounds the fixed support 21. The moving support 82 is held between the arm 102 and the arm 102 so that the moving support 82 may be pressed outward. Thus, the two arms 102, 102 apply an outward force in a direction of an arrow F to the moving support 82, and the coil 101 turns around the fixed support 21 with rotation of the locking lever 8.

When the locking lever 8 is in the unlocking position, the moving support 82 and a crossed point 102*a* of the arms 102 and 102 are positioned in the one side or counterclockwise of the border line A. Thus, the force F of the coil spring 10 acting to the moving support 82 acts to the locking lever 8 in the releasing direction or counterclockwise. From the situation, the locking lever 8 turns in the locking direction to the intermediate position, the moving support 82 is pressed into between the arm 102 and the arm 102 to allow an angle between the arm 102 and the arm 102 to become the maximum. This time, the force F acts toward the center of the pivot 81.

The moving support 82 and the crossed point 102*a* of the arms 102 and 102 crosses the border line A and moves to the other side of the border line A or clockwise. Then, the force F of the coil spring 10 reverses to act the locking lever 8 in the locking direction or clockwise.

Thus, the force that acts to the locking lever 8 supported reciprocally between the two positions, i.e. the unlocking position and locked position reverses at the intermediate position of the moving range. Furthermore, the coil 101 of the coil spring 10 does not move obliquely, so that the force can be reversed smoothly and certainly.

The foregoing merely relate to an embodiment of the invention. Various changes and modifications may be made without departing from the scope of claims as below.

(i) A moving lever may move straight reciprocally along the surface of the base plate 3.

(ii) A coil of a coil spring may be pivotally supported to the moving support 82, while the fixed support 21 may be held between two arms of the coil spring.

(iii) A fixed support may be provided on the base plate 3.

(iv) A moving lever may comprise a lever other than the locking lever.

(v) The forcing device for the moving lever may be used for other than a vehicle door latch device.

What is claimed is:

1. A forcing device for a moving lever, comprising:

a base member comprising a fixed support;

the moving lever that reciprocally moves between a first position and a second position, said moving lever comprising a moving support, said moving lever being pivotally secured on the base member with a pivot; and a coil spring comprising a coil and a pair of arms that extends from the coil and crosses each other, one of the fixed support and the moving support being wound with said coil, the other of the fixed support and the moving support being held between said pair of arms and forced outward, a coil spring force that acts to the moving lever which reciprocally moves between the first position and the second position by the coil spring reversing at an intermediate position of a moving range of the moving lever, said pair of arms being crossed at a crossed point, the crossed point and the moving support crossing a border line that connects the fixed support to a center of the pivot of the moving lever with turning of the moving lever around the pivot, said crossed point and the moving support being in one side with respect to the border line when the moving lever is in the first position and in the other side with respect to the border line when the moving lever is in the second position.

2. A forcing device of claim 1 wherein the fixed support is wound with the coil, while the moving support is held between said pair of arms.

3. A forcing device of claim 1 wherein the moving lever comprises a locking lever.

4. A forcing device of claim 1 wherein the fixed support comprises a projection that limits axial motion of the coil.

5. A forcing device of claim 1 wherein the moving support comprises a collar that limits axial motion of the coil.

* * * * *